US011576513B2

(12) United States Patent
Luckey

(10) Patent No.: US 11,576,513 B2
(45) Date of Patent: Feb. 14, 2023

(54) RECEPTACLE FOR SECURE ACCEPTANCE OF PARCELS AND OF HANGING CLOTHING

(71) Applicant: Lauren Nicole Luckey, Henderson, NV (US)

(72) Inventor: Lauren Nicole Luckey, Henderson, NV (US)

( * ) Notice: Subject to any disclaimer, the term of this patent is extended or adjusted under 35 U.S.C. 154(b) by 564 days.

(21) Appl. No.: 16/726,222

(22) Filed: Dec. 23, 2019

(65) Prior Publication Data

US 2021/0186246 A1 Jun. 24, 2021

(51) Int. Cl.

| | |
|---|---|
| ***A47G 29/30*** | (2006.01) |
| ***A47G 29/14*** | (2006.01) |
| ***A47G 25/14*** | (2006.01) |
| ***A47G 29/22*** | (2006.01) |
| ***A47G 29/124*** | (2006.01) |

(52) U.S. Cl.

CPC ..... *A47G 29/30* (2013.01); *A47G 25/1464* (2013.01); *A47G 29/1251* (2017.08); *A47G 29/141* (2013.01); *A47G 29/22* (2013.01)

(58) Field of Classification Search

CPC ..... A47G 29/30; A47G 29/141; A47G 29/12095; A47G 29/1251; A47G 29/1216; A47G 25/1464; A47G 29/22; A47G 2029/149

USPC ..... 232/43.1, 45, 51, 38, 39

See application file for complete search history.

(56) References Cited

U.S. PATENT DOCUMENTS

| | | | | |
|---|---|---|---|---|
| 492,026 | A * | 2/1893 | Kollenberg | A47G 29/12095 232/45 |
| 1,111,031 | A * | 9/1914 | Petri | A47G 29/12095 43/67 |
| 4,944,422 | A | 7/1990 | Aurness et al. | |
| 5,137,212 | A * | 8/1992 | Fiterman | B65F 1/1468 109/66 |
| 5,435,484 | A * | 7/1995 | Carlson | A47G 29/1251 232/47 |
| 5,774,053 | A | 6/1998 | Porter | |
| 5,979,750 | A | 11/1999 | Kindell | |
| 6,247,642 | B1 * | 6/2001 | Wilson, Jr. | A47G 29/12095 232/47 |
| 6,375,070 | B1 * | 4/2002 | Snoke | A47G 29/141 232/27 |
| 6,412,688 | B1 | 7/2002 | Tucker et al. | |
| 6,426,699 | B1 | 7/2002 | Porter | |
| 6,480,758 | B2 | 11/2002 | Stevens | |
| 6,612,489 | B2 | 9/2003 | McCormick et al. | |
| 6,967,575 | B1 * | 11/2005 | Dohrmann | G06Q 20/367 340/5.31 |

(Continued)

*Primary Examiner* — William L Miller

(74) *Attorney, Agent, or Firm* — Connie R. Masters

(57) ABSTRACT

A deposit receptacle for secure acceptance of parcels and of hanging clothing is provided that prevents unauthorized removal of the deposited articles. The deposit receptacle includes a one-part or multi-part frame, a roof, a floor, a front pivoting upper input door, a front locking hinged lower retrieval door, a locking hinged side access door for both deposit and retrieval, a clothing hanger installed within the roof, a front panel, and a securing system incorporated into the floor that enables the deposit receptacle to be securely and easily fastened to the supporting structure upon which the receptacle is resting.

20 Claims, 15 Drawing Sheets

(56) References Cited

U.S. PATENT DOCUMENTS

| | | | | |
|---|---|---|---|---|
| 7,048,177 | B1 * | 5/2006 | Franklin | A47G 29/12095 232/17 |
| 7,246,738 | B2 | 7/2007 | Jonas | |
| 7,822,618 | B2 | 10/2010 | Kaneko | |
| 8,358,199 | B2 | 1/2013 | Nesling | |
| 8,740,056 | B2 | 6/2014 | Skouboe | |
| 9,004,346 | B2 | 4/2015 | Farentinos et al. | |
| 9,327,887 | B2 | 5/2016 | Farentinos et al. | |
| 9,554,646 | B1 | 1/2017 | Charette et al. | |
| 9,700,168 | B1 | 7/2017 | Evans | |
| 10,292,519 | B1 * | 5/2019 | Sutton | A47G 29/16 |
| 2001/0040422 | A1 | 11/2001 | Gramlich | |
| 2001/0045449 | A1 | 11/2001 | Shannon | |
| 2002/0147919 | A1 | 10/2002 | Gentry | |
| 2003/0154891 | A1 | 8/2003 | Fassbender et al. | |
| 2006/0103519 | A1 | 5/2006 | Woods | |
| 2008/0067227 | A1 * | 3/2008 | Poss | H02J 9/005 340/569 |
| 2014/0008246 | A1 | 1/2014 | Pfeiffer | |
| 2017/0091710 | A1 | 3/2017 | Dyke | |
| 2020/0107664 | A1 * | 4/2020 | Yang | A47G 29/1248 |
| 2020/0237132 | A1 * | 7/2020 | Kaechele | A47G 29/1251 |
| 2021/0030185 | A1 * | 2/2021 | Rogers | G06Q 10/083 |
| 2022/0007871 | A1 * | 1/2022 | Schwarz | B64D 9/00 |

* cited by examiner

RECEPTACLE FOR SECURE ACCEPTANCE OF PARCELS AND OF HANGING CLOTHING

FIELD OF INVENTION

This invention relates generally to deposit receptacles, and, more particularly, to a deposit receptacle for secure acceptance of parcels and of hanging clothing that prevents unauthorized removal of the deposited articles and that is convenient to secure to a supporting surface.

BACKGROUND OF THE INVENTION

Numerous types of delivery receptacles are known that may receive and hold a particular type of goods until the recipient can retrieve the goods. These delivery receptacles are typically box-like structures. They are generally placed near a residential door, such as on a porch or landing, which is accessible to the delivery carrier for input and convenient for the recipient for retrieval.

Many available delivery receptacles do not provide protection against theft but merely have a housing with a hinged door into which a delivery carrier places the goods, which protects the packages from exposure to the elements, removes the goods from viewing by passers-by, and may provide a measure of temperature control. An example of this type is an insulated receptacle that is placed outside a recipient's home for receiving refrigerated foods, such as milk or groceries, that need to be maintained within a temperature range. Often there is no means to secure the contents of these receptacles, and due to the lack of any security features, there is an opportunity for theft.

Some delivery receptacles are designed to receive only parcels, but other delivery receptacles are specifically designed to receive other types of goods, such as food products, medical samples, hanging clothing, or other types of wares. Each of these good-specific receptacles may serve a recipient's need for receiving that particular good. However, as residential delivery has become more popular, recipients increasingly have a need to receive more than one type of good. In this case, the recipient may need multiple ones of these good-specific receptacles. A recipient may, for example, have a first receptacle to receive parcels and a separate receptacle to receive clean laundry from a laundromat or from a dry-cleaning facility. However, it is typically problematic to position multiple receptacles near the residential door because of the limited space. Further, multiple receptacles are not attractive thus reducing residence's curb appeal.

Therefore, though there is a need for a delivery receptacle that can accept both parcels and laundry, due to the size limitations placed on the delivery receptacle by the limited space available at a residential door, an efficient combination is not easy to design. An attempt to create a combination parcel and laundry delivery receptacle is disclosed in U.S. Pat. No. 5,774,053 issued to Porter that includes a locked front hinged door for delivery and an opposing rear hinged door for retrieval. Though both clothing and parcels can be input into the locked front hinged door, the single locked input door is not efficient or convenient. Parcel deliveries to a residential address may typically be provided by multiple parcel delivery companies, such as FedEx, Amazon, Wal-Mart, Office Depot, UPS, and the like. Laundry may be delivered by a dry-cleaning facility. Thus, it is highly inconvenient to provide a key or a keycode to each of the many possible delivery companies, who are not likely to want to receive the key or keycode, to develop procedures for distributing the keys or keycodes, or to assume the liability of receiving the key or keycode. Additionally, distributing the keys or keycode widely reduces security. It would be advantageous to have an unlocked door for ease of depositing parcels, but then retain the delivered parcels in a secure, locked location.

Additionally, the available deposit receptacles have limited options to attach the receptacle to the supporting surface. In some receptacle installations, the installer must drill holes in the bottom of the receptacle and then install concrete anchors or wood screws through the drilled holes. This will, at a minimum, be unsightly, but may also cause weakness in the structure. Other receptacles have pre-drilled holes for use with concrete anchors or wood screws. In either of these situations, the holes are not easily accessible to the installer, so this design creates an awkward and potentially installation. Some deposit receptacles have an externally accessible attachment device along the bottom edge of the receptacle that can be used to attach the deposit receptacle to the supporting surface. This is more convenient for the installer but is not secure, because unauthorized persons can also access the externally accessible attachment system.

It does not appear that it is taught or disclosed to provide a delivery receptacle that can receive both parcels and hanging clothing, that has an upper deposit-only pivoting door that allows easy delivery without a key or keycode, that allows holding the parcel in a locked enclosure, that has a lower hinged retrieval door, that has a locked side door for accessing the clothing hanger, and a non-externally-accessible securing system that allows convenient securing of the receptacle to the supporting surface. Accordingly, there is a need for such a device, which is easy to install, and which will efficiently allow deposit, secure retention, and easy retrieval of both parcels and hanging clothing in a single compact structure.

The discussion above is merely provided for general background information and is not intended to be used as an aid in determining the scope of the claimed subject matter.

BRIEF SUMMARY OF THE INVENTION

The present invention is directed to a deposit receptacle suitable for installation at a residential or commercial location that allows delivery persons to introduce packages and/or hanging clothing into the deposit receptacle, holds the packages and/or clothing in a secure compartment, and allows removal of the deposited articles only by an authorized recipient, such as a resident of the home or a business owner. The deposit receptacle also has a securing system that is not externally accessible and that can be used to efficiently install the receptacle at a pre-determined location that is easily accessible to delivery personnel for deposit and to the authorized user for retrieval. The deposit receptacle includes an external housing, a hanger system, and a securing system.

The external housing includes a floor portion attached to a vertically extending frame that is attached to and supports a roof portion. The frame supports three doors (a front pivoting upper input door, a front locking hinged lower retrieval door, and a locking hinged side access door). The bottom or floor portion is conveniently attached by the securing system to the supporting surface upon which it is resting, such as a concrete or wood porch, foundation, pavement, sidewalk, portion of a structure, ground, or other material forming a foundation upon which the deposit receptacle is to rest. The supporting surface may be a naturally occurring surface such as the ground, may be a pre-installed part of the residence or business, such as a porch or concrete entryway, or may be installed particularly to receive the deposit receptacle, such as a concrete slab poured to enable attachment of the deposit receptacle, a wood platform secured by anchors driven into the ground near the pre-determined entrance location, or other structure specifically installed to create a secure footing to which the deposit receptacle is to be attached and is to rest upon.

The three door openings into the interior storage compartment serve multiple purposes. The front pivoting upper input door allows one or more parcels to be easily deposited into the secure interior compartment by delivery personnel. The front locking hinged lower retrieval door allows a user to collect the deposited parcels. The locking hinged side access door allows a delivery person to deposit hanging clothing onto an installed hanger system disposed within the roof portion of the receptacle, and also allows the user to collect the hanging clothes and/or the deposited parcels.

Therefore, the disclosed delivery receptacle can receive both parcels and hanging clothing, allows easy delivery without a key or keycode via the upper deposit-only pivoting door, holds the delivered parcel in a locked enclosure, allows parcel retrieval via a front locking hinged lower retrieval door, allows access to an interior clothing hanger via the locking hinged side access door, and can be conveniently attached to the supporting surface via a securing system that is not externally accessible.

In an aspect of the invention, the deposit receptacle has a keyed lock on the front lower retrieval door.

In another aspect of the invention, the deposit receptacle has a keypad lock on the front lower retrieval door.

In an additional aspect of the invention, the deposit receptacle has a lock on the front lower retrieval door that has wireless signal receiving and/or transmitting capabilities and can be unlocked via Bluetooth or similar RFID technologies.

In a further aspect of the invention, the deposit receptacle has a keyed lock on the side access door.

In another aspect of the invention, the deposit receptacle has a keypad lock on the side access door.

In an additional aspect of the invention, the deposit receptacle has a lock on the side access door that has wireless signal receiving and/or transmitting capabilities and can be unlocked via Bluetooth or similar RFID technologies.

In a further aspect of the invention, the deposit receptacle has a flat roof.

In another aspect of the invention, the deposit receptacle has a peaked roof.

In an additional aspect of the invention, the deposit receptacle has a clothing hanger installed within the peaked portion of the roof.

In a further aspect of the invention, the frame is a one-part frame.

In another aspect of the invention, the frame is a two-part frame.

The object of the invention is to provide a deposit receptacle which gives an improved performance over the above described prior art systems and methods.

These and other objects, features, and advantages of the present invention will become more readily apparent from the attached drawings and from the detailed description of the preferred embodiments which follow.

BRIEF DESCRIPTION OF THE SEVERAL VIEWS OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
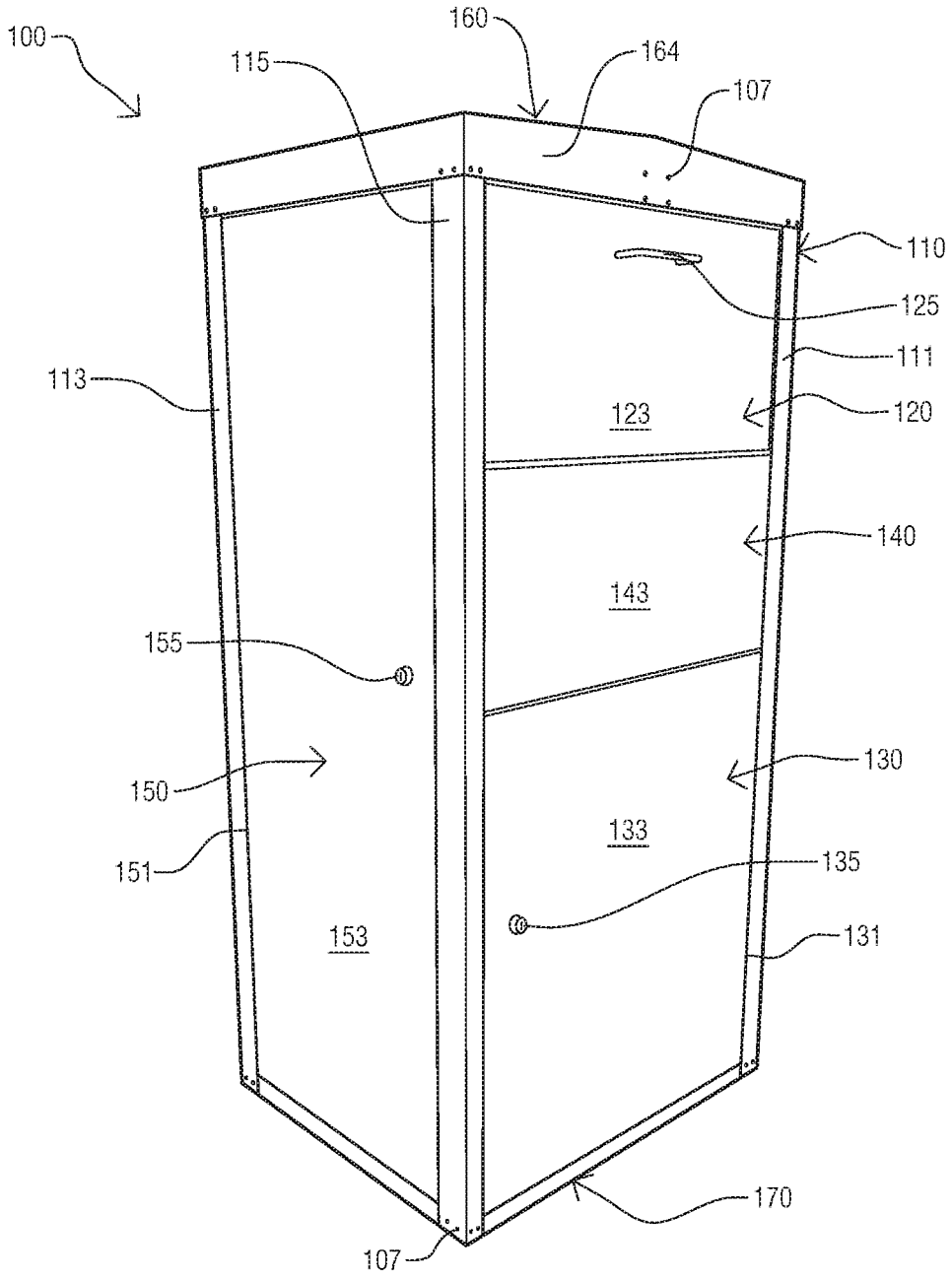
FIG. 1 is a perspective view as seen from the left front corner of an embodiment of the deposit receptacle of the present invention with the three doors closed.

Shown throughout the figures, the present invention is directed toward a deposit receptacle, shown generally as reference number 100. The deposit receptacle 100 is designed for convenient installation at a residential or commercial location via use of the efficient two-piece securing system 190 (FIG. 4). It allows delivery personnel to introduce parcels into the deposit receptacle 100 through a front pivoting upper input door 120 without the need for a key, keycode, or wireless unlocking system. It also allows delivery personnel to deliver hanging clothing through the hinged side access door 150 that gives access to a hanger system 180 (FIG. 3) so that the clothes remain unwrinkled. Both the parcels and the hanging clothing are held in a secure interior compartment 101 (FIG. 4). The deposit receptacle 100 only allows removal of the deposited articles by an authorized person, such as the resident of the home, the business owner, or other authorized user through usage of a lower front locking hinged lower retrieval door 130 or the locking hinged side access door 150.

The deposit receptacle 100 comprises an exterior housing 105 (FIG. 4), an interior clothing hanging system 180 (FIG. 3), and an anchoring/securing system 190. The exterior housing 105 (FIG. 4) encloses the interior compartment 101. The housing 105 comprises, as seen in FIG. 1, a frame 110, a front pivoting upper input door 120 supported by the frame 110, a front locking hinged lower retrieval door 130 supported by the frame 110, a front panel 140 supported by the frame 110, a side access door 150 supported by the frame 110, a roof portion 160 that encloses the top of the exterior housing 105 and that is attached to the top of the frame 110, and a floor portion 170 (FIGS. 4, 8) that encloses the bottom of the exterior housing 105 and that is attached to the bottom of the frame 110.

Figure 8:
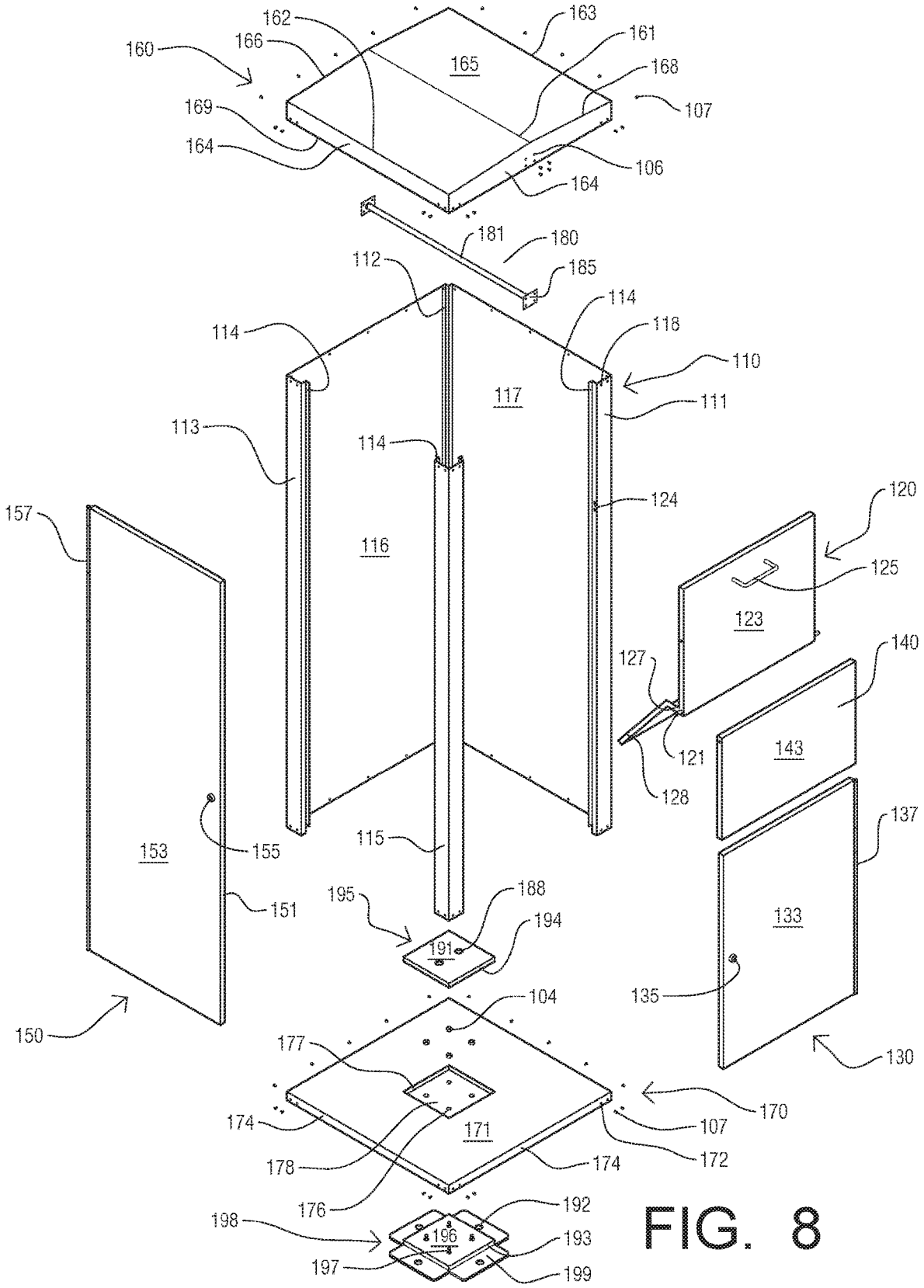
FIG. 8 is a perspective exploded view of an embodiment of the deposit receptacle of the present invention.
Figure 9:
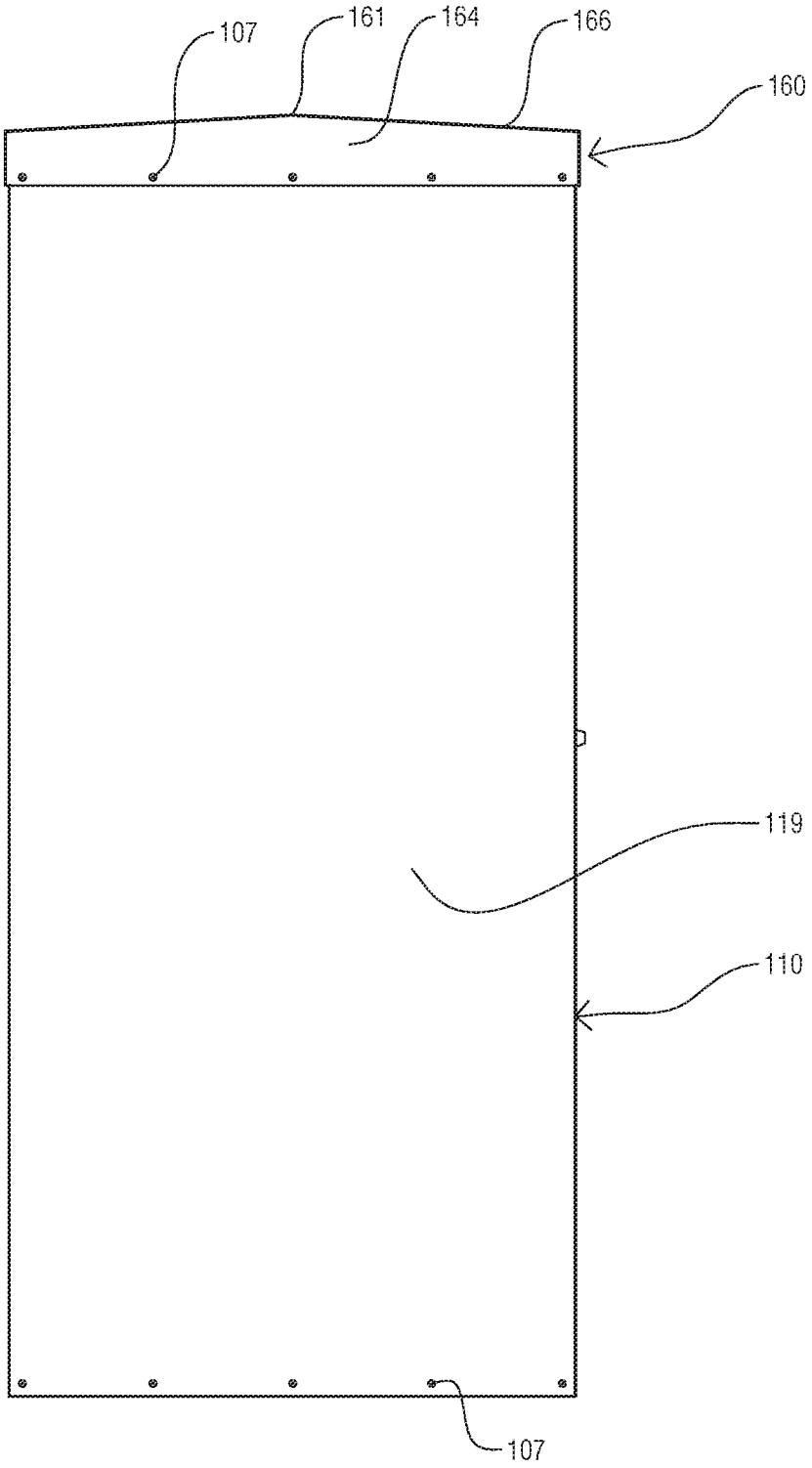
FIG. 9 is a back view of an embodiment of the deposit receptacle of the present invention.
Figure 10:
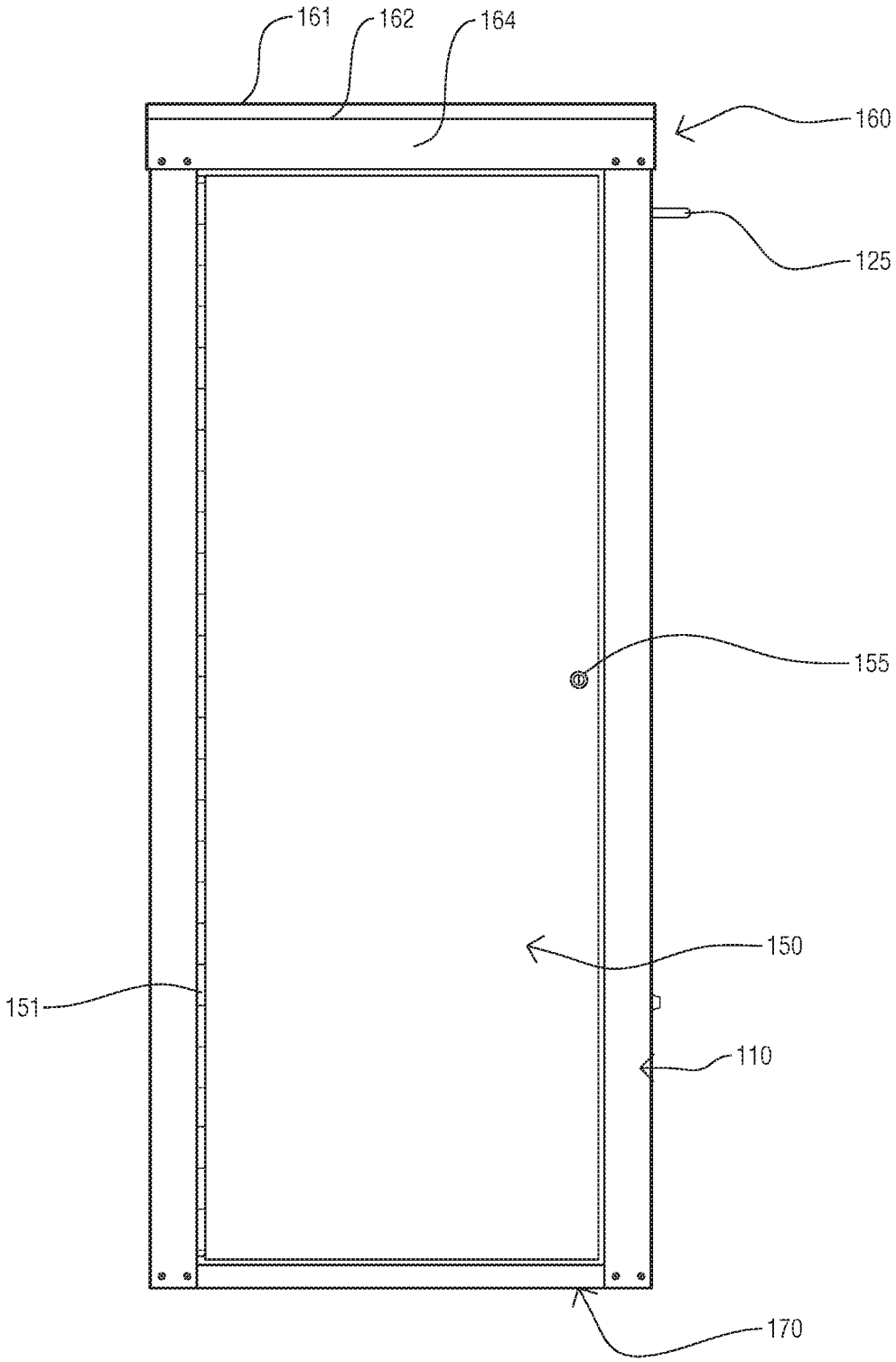
FIG. 10 is a left side view of an embodiment of the deposit receptacle of the present invention showing the locking hinged side access door.
Figure 11:
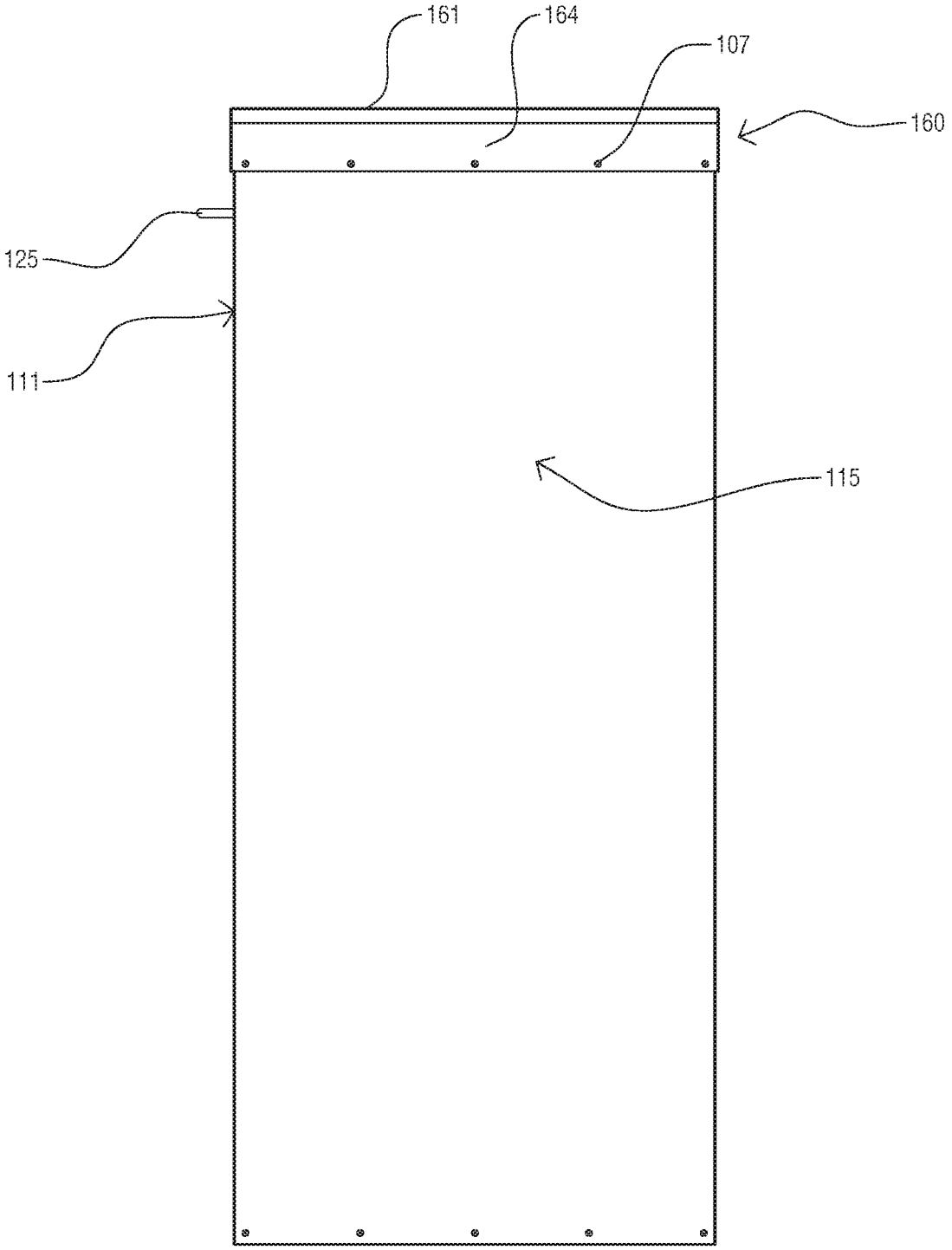
FIG. 11 is a right side view of an embodiment of the deposit receptacle of the present invention.
Figure 12:
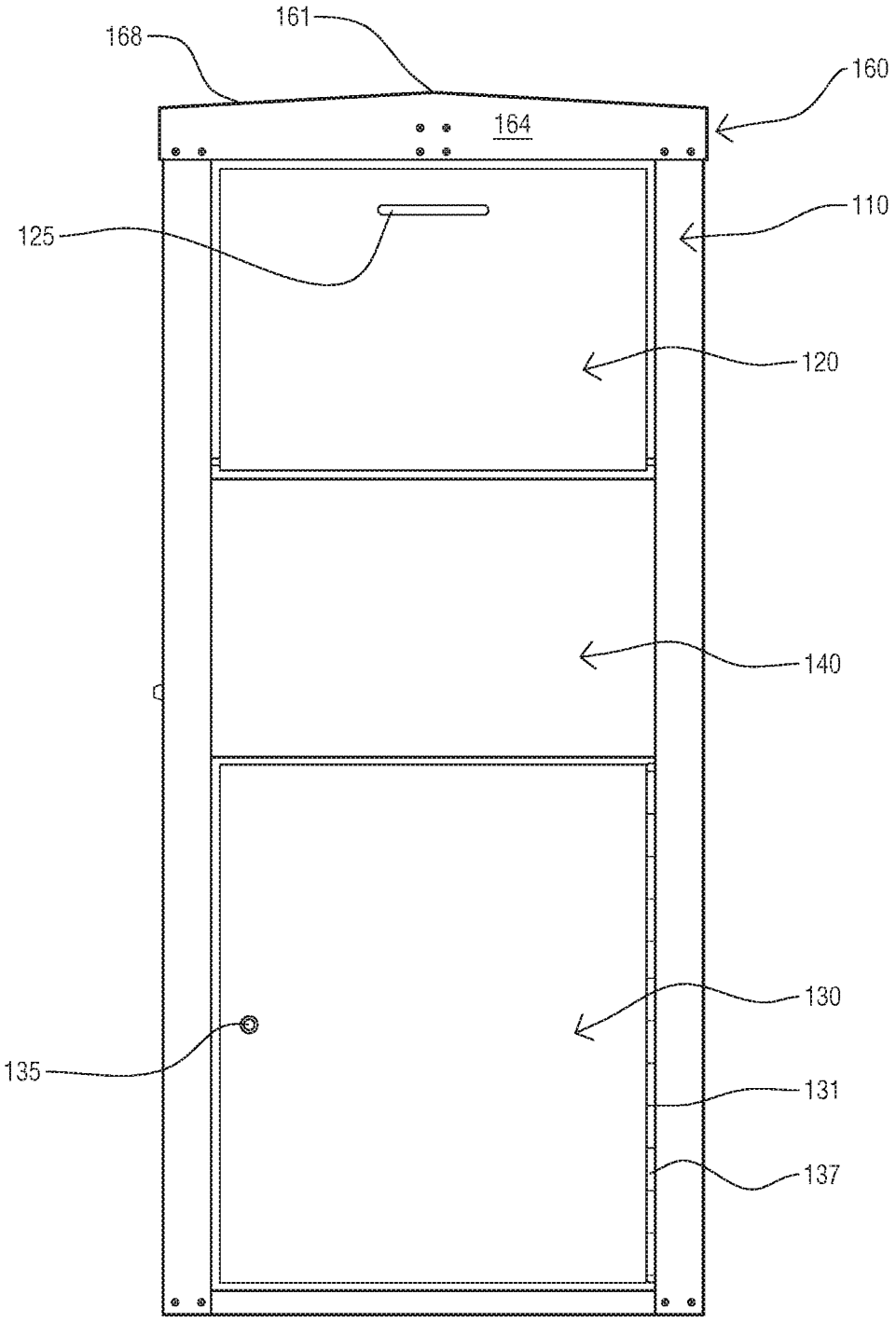
FIG. 12 is a front view of an embodiment of the deposit receptacle of the present invention.
Figure 13:
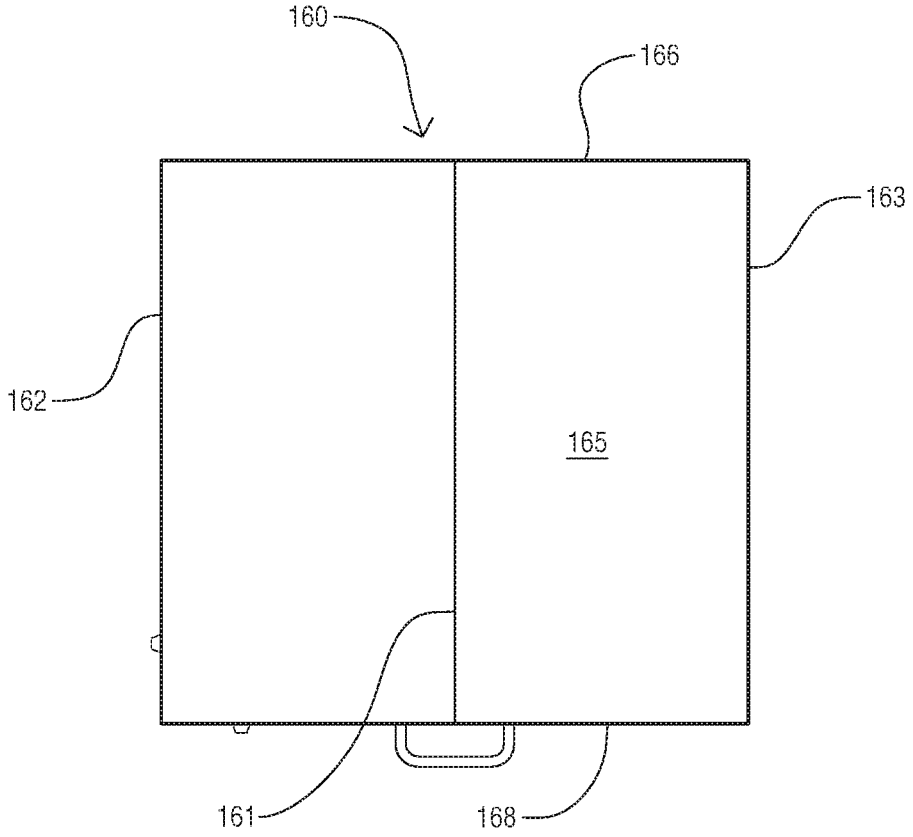
FIG. 13 is a top view of an embodiment of the deposit receptacle of the present invention.

The securing system 190 comprises both a lower element or base 198 and an upper element or cover 195 (FIG. 8). When installed, the base 198 is attached to the supporting surface upon which the receptacle 100 is to rest with the base's upwardly projecting bolts 197 protruding through holes defined by floor hole edges 176 (FIG. 8). Mating nuts 104 are threadingly engaged with the bolts 197 to attach the receptacle to the installed base 198. To finish the installation, the cover 195 is disposed within a central recessed area 178 of the floor portion 170 of the external housing 105, which conceals the bolts 197 and nuts 104.

Figure 3:
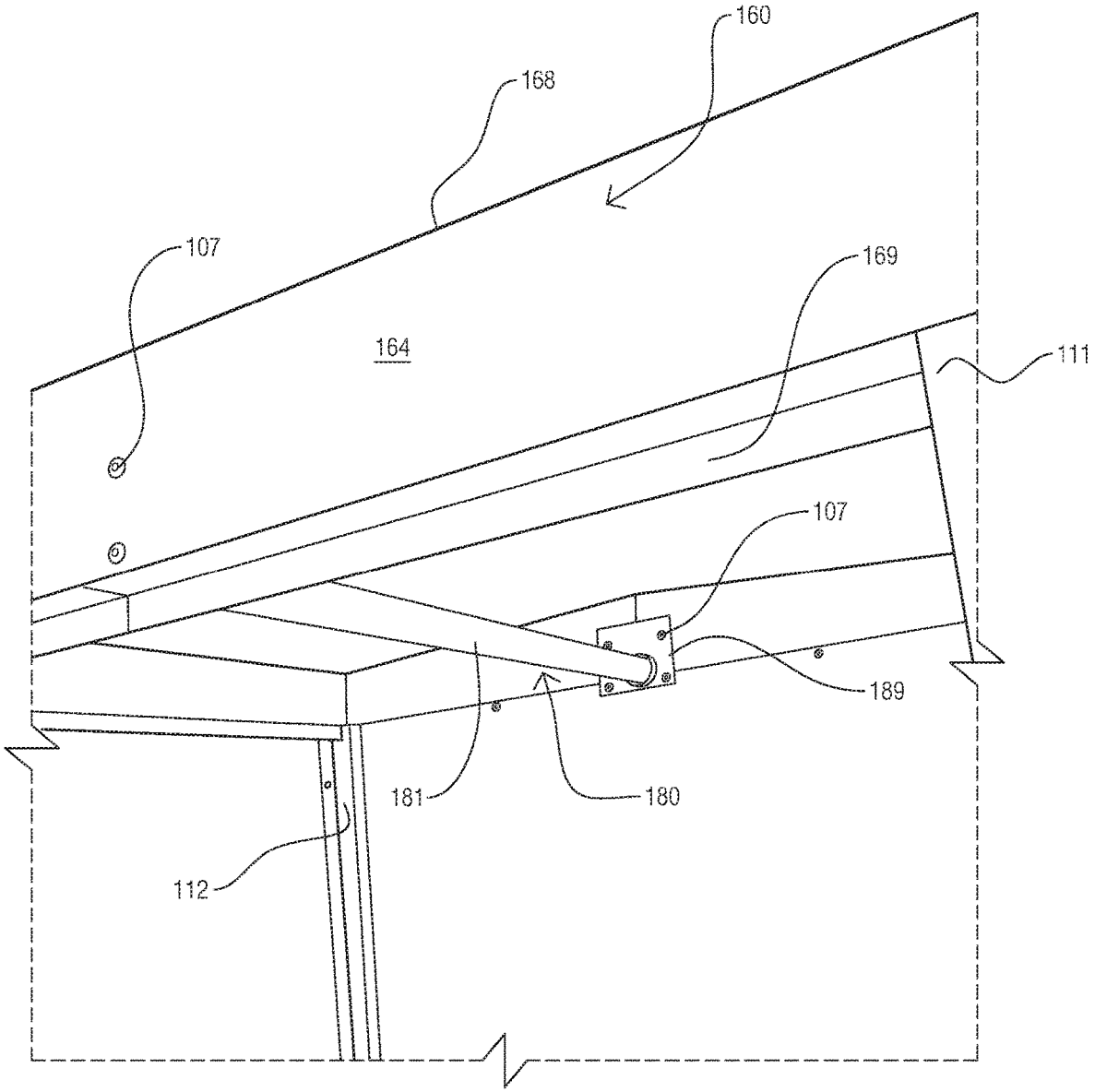
FIG. 3 is a perspective view of the interior of the roof portion of an embodiment of the present invention showing the installed interior clothing hanger.
Figure 4:
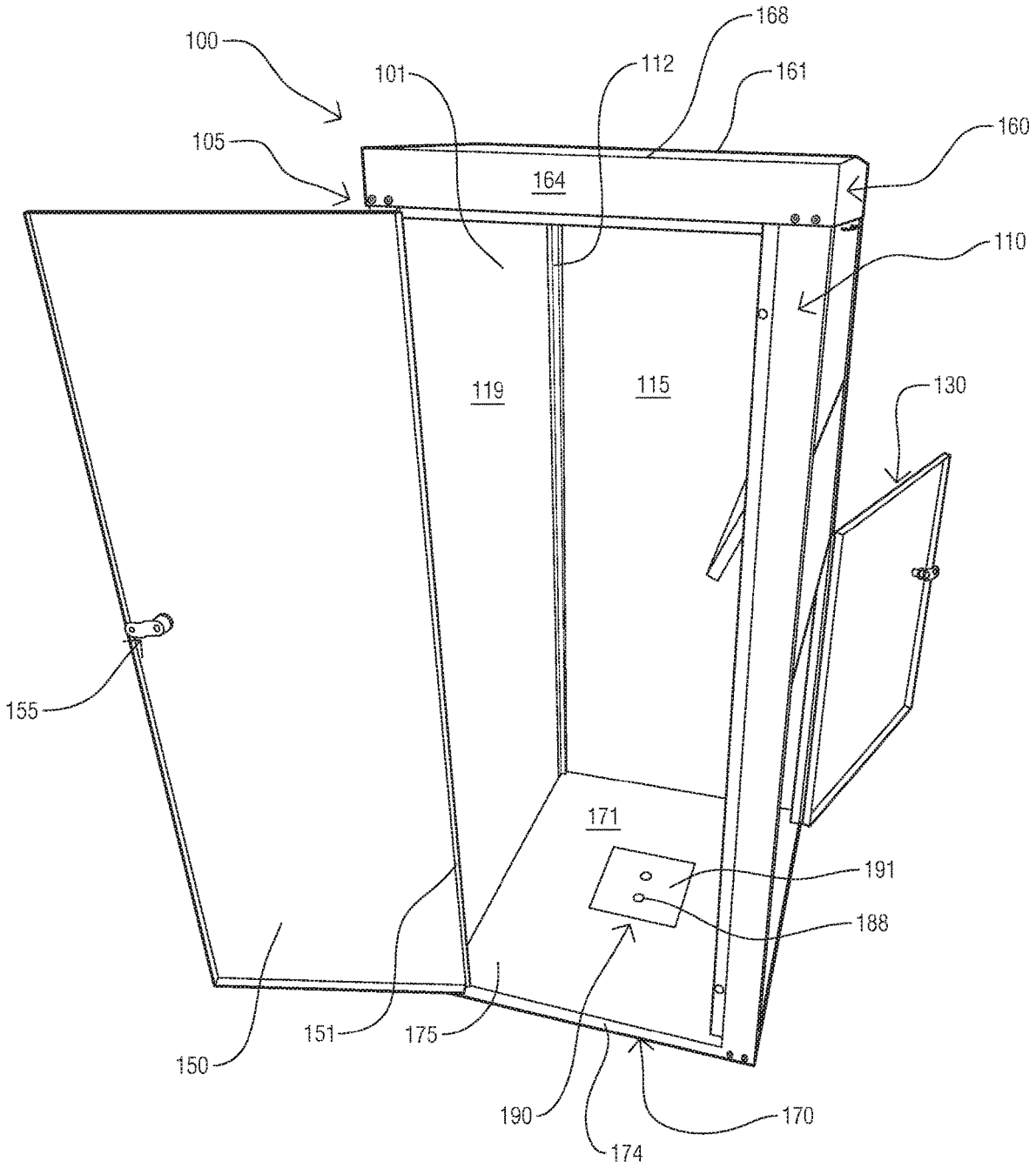
FIG. 4 is a perspective view of an embodiment of the present invention showing the interior compartment and the top cover portion of the anchoring and/or securing system.

As seen in FIG. 3, the clothing hanger system 180 comprises a hanger rod 181 fixedly attached between opposing flat plates 185. The opposing flat end plates 185 are used to attach the hanger rod 181 to the interior of the exterior housing 105 within or substantially within the roof portion 160 of the housing 105.

The roof portion 160 supplies a permanently attached top cover for the deposit receptacle 100. It comprises a horizontally extending top covering 165 (FIG. 8) and four smaller downwardly extending sidewalls 164. The sidewalls 164 serve to facilitate the attachment of the roof portion 160 to the frame 110. The top covering 165 may be planar (FIG. 14) or peaked (FIGS. 1-2, 8-13). The planar aspect of the top covering 165 may be suitable when the deposit receptacle 100 is intended for usage under a roof or an overhang of a building where it is not exposed to rain. The peaked aspect of the top covering 165 may suitably be used either when the deposit receptacle is to be situated in a location that is sheltered by a portion of a building, but it is especially useful when the receptacle 100 will be exposed to the elements, because the peaked top covering 165 will not let rain pool on the roof 160. The peaked top covering 165 may be formed of two surfaces angled to create a central elevated peak 161, which preferably extends from back to front (longitudinally) of the deposit receptacle 100. In one aspect, the top covering 165 portion may be integrally formed with the four downwardly extending sidewalls 164. For example, the top covering 165 and the sidewalls 164 may be formed as a unitary element by metal molding or casting or by cutting a single sheet of metal to create side flaps at the four sides of the top covering 165, and then bending the side flaps to orient them substantially vertically. In another aspect the top covering 165 may be formed of multiple pieces joined to form the roof portion 160. For example, the top covering 165 may be formed separately from the sidewalls 164, with the sidewalls permanently attached to the top covering 165 and oriented substantially vertically, as illustrated.

The sidewalls extend downwardly from roof corner edges 162, 163, 166, and 168 (FIG. 8) a sufficient distance to facilitate attachment of the roof portion 160 to the frame 110. This attachment may be any permanent attachment as is known in the art. For example, the top portion 160 may be configured with holes 106, and the tops of the frame posts 111, 112, 113, 115 may be configured with corresponding holes 118. Standard fasteners 107, such as rivets or nuts and bolts, may then be used to join the two pieces. Alternatively, the roof 160 may be adhesively attached to the frame 110, or a combination of mechanical fasteners and adhesive may be utilized.

Best seen in FIG. 8, disposed within or substantially within the interior of the roof portion 160 is the clothes hanging system 180, which comprises a hanger rod 181 with its opposing ends fixedly attached to flat plates 185 that are used for attaching the rod 181 within the interior portion of the roof 160. The rod 181 has a length slightly shorter than the longitudinal depth of the receptacle 100 to allow it to be fitted into the interior of the roof portion 160. The rod 181 extends longitudinally from the interior of the front portion of the roof to the interior of the rear portion of the roof 160. The plates 185 are preferably configured with holes to receive standard fasteners 107 to permanently attach the rod 181 to the front sidewall 164 and to the back sidewall 164, which installs the rod 181 into the interior of the roof 160. Other types of permanent attachment fasteners or adhesives may alternatively be used.

Figure 2:
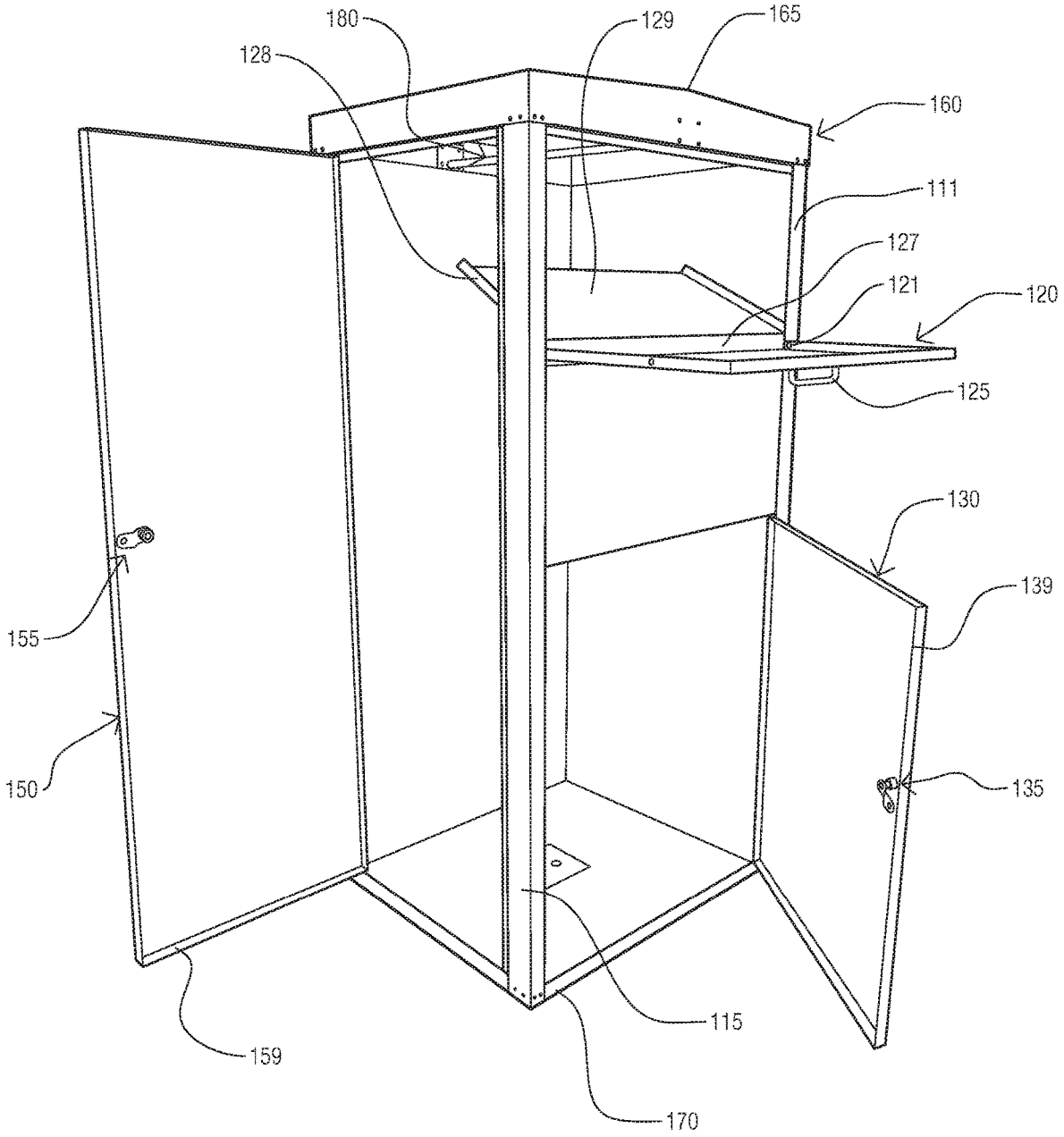
FIG. 2 is a perspective view as seen from the left front corner of an embodiment of the deposit receptacle of the present invention with the three doors open allowing viewing of the interior compartment.
Figure 14:
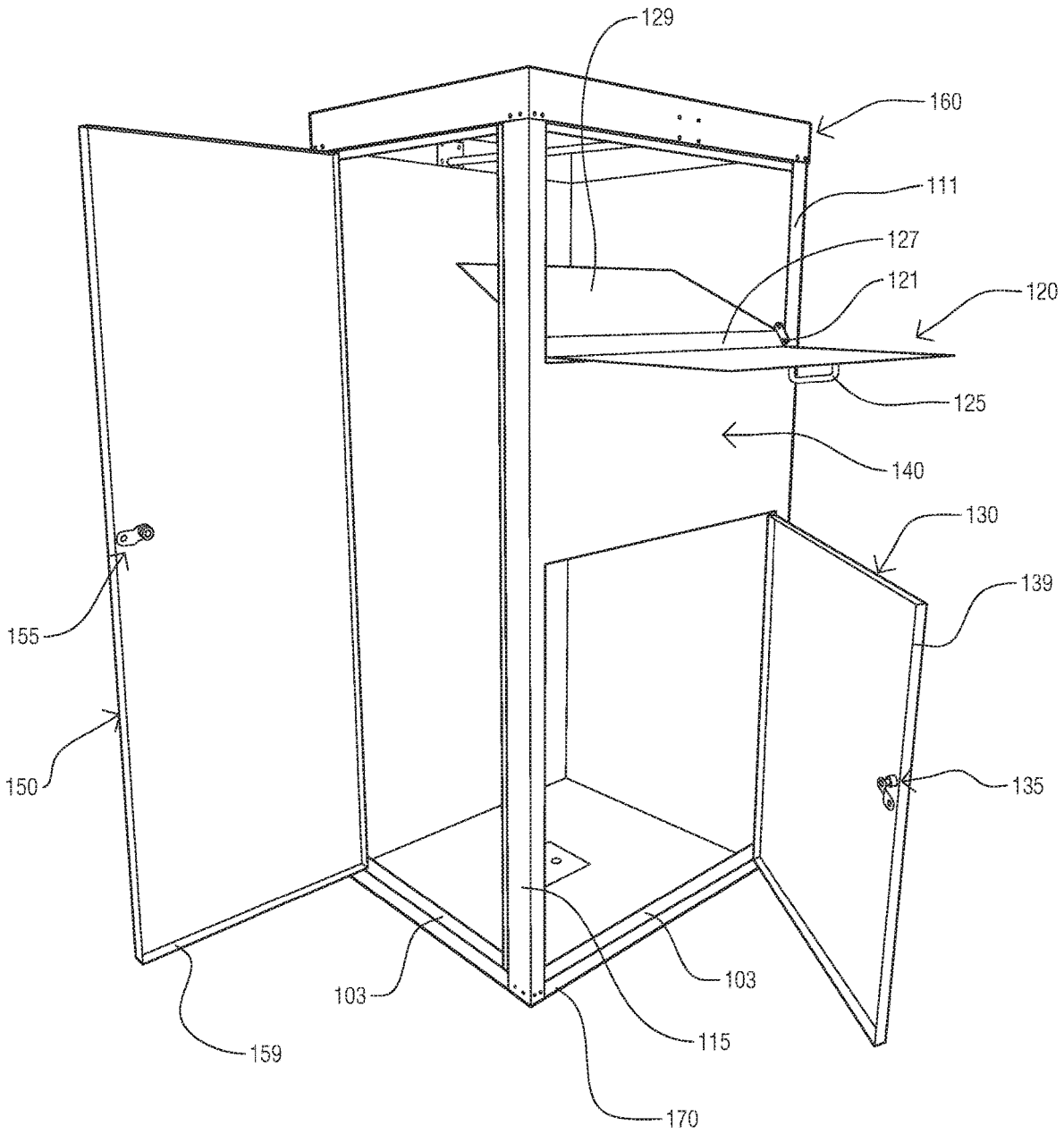
FIG. 14 is a perspective view as seen from the left front corner of a second embodiment of the deposit receptacle of the present invention with the three doors open allowing viewing of the interior compartment.

The frame 110 may be a multi-part frame (FIGS. 1, 8) or a one-part frame (FIG. 14). In the two-part frame 110 shown in FIGS. 1 and 8, the frame 110 comprises a front left post 115 and a two-panel cornered portion. The two-panel portion includes the back panel 116 and the side panel 117 along with the posts 111, 113. The posts 111, 113 and panels 116, 117 extend vertically between the floor 170 and the roof 160. The posts 111, 113 support the right front and left rear corners of the two-panel cornered portion and of the deposit receptacle 100, respectively. The right front post 111 is connected to, and forms a right angle with, the right front of vertical panel 117. The left rear post 113 is connected to, and forms a right angle with, the left side of vertical panel 116. In a preferred aspect of the invention, as seen in FIG. 2, the vertical panel 116 forms a corner with vertical panel 117 with no support post at the corner. In this aspect, the back vertical panel 116 extends laterally between the right rear post 113 and the corner with side vertical panel 117, and the side vertical panel 117 extends longitudinally between the corner with the back vertical panel 116 and the right front post 111. In another aspect of the invention, as seen in FIG. 8, a right rear support post 112 may be included to support the corner between the vertical panels 116, 117. In this aspect, the back vertical panel 116 extends laterally between the left rear post 113 and the right rear post 112, and the side vertical panel 117 extends longitudinally between the right rear post 112 and the right front post in. The two or three posts and two panels may be formed unitarily or formed separately and permanently joined together.

The left front post 115 extends vertically between the floor 170 and the roof 160 and, in the two-part frame 110 aspect, is a separate piece from the two-panel portion, though it is connected to the two-panel portion by the floor 170, the roof 160, and the front panel 140. In the one-part frame aspect, as seen in FIG. 14, the left front post 15 may be connected to the right front post 111 and/or to the left rear post 113 by a support strut 103 running between the left front post 115 and the right front post 111 and/or by a strut 103 running between the left front post 115 and the left rear post 113. The strut(s) 103 is disposed in a location that minimizes blockage of the door openings. Though the strut 103 is illustrated as disposed near the floor 170, one or multiple struts 103 may optionally or additionally be disposed near the roof 160.

The top portions of the posts 115, 111, 112, 113, the back panel 116, and/or the side panel 117 may be configured with holes 118 that correspond to holes 106 in the roof 160, which will allow insertion of the fasteners 107 to securely attach the roof 160 to the frame 110. The bottom portions of the posts 115, 111, 112, 113, the back panel 116, and/or the side panel 117 may be configured with holes 118 that correspond to the holes 172 of the floor 170, which will allow insertion of fasteners 107 to securely attach the floor 170 to the frame 110.

The inward vertical edges of the right front post 111, left front post 115, and left rear post 113 are preferably configured with a lip 114 against which the vertical edges of the front pivoting upper input door 120, the front locking hinged lower retrieval door 130, and the side access door 150 abut when the doors are in the closed position. When the doors are in the closed position, the outer surfaces of the doors are substantially in line with or flush with the outer surfaces of the posts 115, 111, 113 to give a finished look.

Figure 15:
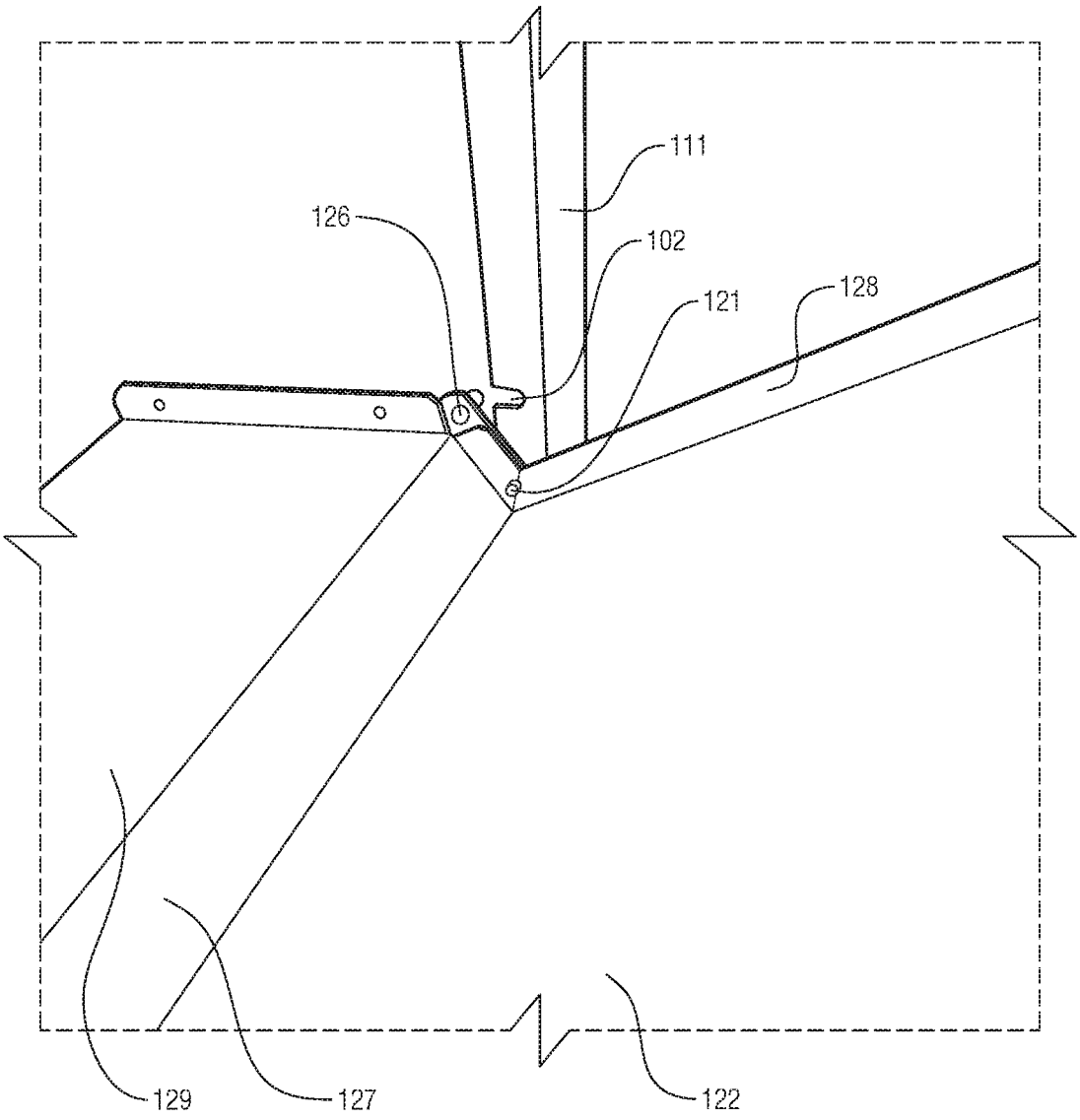
FIG. 15 is a detail view of the inner right corner of the front pivoting upper input door.

As seen in FIGS. 2, 8 and 15, the front pivoting upper input door 120 comprises a flat front face panel 123, a flat shelf ledge 127 attached at an angle along the rear edge of the front face panel 123, and a flat rear shelf 129 attached at an angle along the rear edge of the shelf ledge 127, as illustrated.

The three main elements of the front pivoting upper input door 120, the front face panel 123, ledge 127, and shelf 129, all have a substantially equal width, which is a width slightly less than the horizontal distance between the front posts 111, 115 to allow the input door 120 to fit between the posts 111, 115, but without a significant gap. In one aspect of the invention, all three main elements are configured with an upwardly-projecting side barrier 128 (FIGS. 2, 8) that forms a generally ninety-degree angle with each element to assist in guidance of the parcel into the interior of the receptacle 100. In another aspect of the invention, the rear shelf 129 lacks the upwardly-projecting side barrier 128 as seen in FIG. 14.

Disposed centrally on the upper half of the front face panel 123 is a handle 125 that is used to manually pivot the input door 120 to open and close it. The front face panel 123, when the input door 120 is in the closed position, is aligned with the front panel 140 and the side posts 111, 115. The flat front face panel 123 extends laterally between the front side posts 111, 115 and extends vertically between the front panel 140 and the bottom of the roof 160.

Two pivot pins 121 (FIG. 8), upon which the front pivoting upper input door 120 rotate, are disposed on opposing sides at the rear of the front face panel 123, preferably the pivot pins 121 are disposed on or within the side barrier 128 of the opposing rear corners at which the ledge 127 meets the front face panel 123.

The rear shelf 129 extends into the interior compartment 101 a distance less than the depth of the deposit receptacle 100, so as not to interfere with the pivoting of the input door 120. The shelf 129 pivots with the ledge 127 and the front face panel 123 of the input door 120. When the input door 120 is opened, the shelf 129 is rotated upwardly to form a flat surface onto which the parcel may be set. When the input door 120 is rotated to a closed position, the parcel slides off the back of the shelf 129 and is pulled downward by the force of gravity to rest on the top surface 171 of the floor 170.

The inward vertical edges of the right front post 111 and the left front post 115 are configured with a hole 124 (FIG. 8) to receive a portion of the pivot pin 121 upon which the front pivoting upper input door 120 rotates from the open position to the closed position.

Preferably the inward vertical edges of the right front post 111 and the left front post 115 are configured with a notch 102 (FIG. 15) into which a pin or stop 126 is rotated when the front pivoting upper input door 120 is pivoted on pivot pin 121 into the closed position. The notch 102 is sized and shaped to receive the stop 126, which restricts the movement of the door 130. The notch 102 and the stop 126 are shaped and located to allow the front face panel 123 to be maximally rotated to a position substantially parallel to the supporting surface. This restriction of the rotation prevents the outer edge of the front face 123 from rotating further downward and damaging the face of the front panel 140, which is directly below it.

The front panel 140 extends laterally between the right front post 111 and the left front post 115. In the preferred embodiment of FIGS. 1-2, 8, the front panel 140 is a separate piece that is configured to fit into the lips 14 of the right front post 111 and the left front post 115 to create a flush surface, with the front surface 143 of the front panel 140 substantially planar to the front surface of the right front post 111 and the left front post 115. In another aspect of the invention, the front panel 140 may be formed integrally with the right front post 111 and the left front post 115, as shown in FIG. 14.

The lower front retrieval door 130 comprises a hinge 137 (FIG. 8) disposed along one vertical edge and a front face panel 133 preferably surrounded by a lip 131 that is sized to fit into the lip 14 of the frame 110. The lower front retrieval door 130 extends laterally between the two side posts 111, 115 and extends vertically between the bottom of the front panel 140 and the top of the floor 170. When closed, the outer surface of the front face panel 133 of the retrieval door 130 is substantially planar with the outer surface of the front panel 140, the outer surface of side posts 111, 115, and the outer surface of the flange 174 of the floor 170. The lower front retrieval door 130 may be hinged on either the right or left vertical side to allow the retrieval door 130 to be manually opened. A door handle may be disposed on the side opposing the hinge. A manual or electronic lock 135 is disposed on the side of the retrieval door 130 opposite the hinge 137.

The side access door 150 comprises an access door front face panel 153, a hinge 157 (FIG. 8), a lock 155, and preferably a lip 151 surrounding the front face panel 153. The front face panel 153 extends longitudinally between the side posts 3, 15 and extends vertically between the roof 160 and the floor 170. The manual or electronic lock 155 is disposed on the side of the access door 150 opposite the hinge 157. The access door 150 is hinged to allow the door 150 to swing open and to be manually shut. The hinge 157 may be disposed on either the front or rear vertical side of the access door 150, but is preferably disposed on the read vertical side, as illustrated. A handle may be disposed centrally on the side of the door opposite the hinge 157 to allow easy opening and shutting of the access door.

The lock 155 may be a keyed lock, an electronic lock that is unlocked with a keycode (usually by touching numbers on a keypad), or an electronic lock that utilizes a short-range wireless transmission. In the case of the short-range wireless transmission the receptacle is unlocked by the delivery carrier who uses a short-range wireless transmitter and who then places the parcel into the receptacle; the recipient unlocks the receptacle by usage of a second short-range wireless transmitter that transmits to the installed electronic lock. The short-range wireless transmitter may be a cell phone or a dedicated device. Separately, in another aspect of the invention, an electronic user notification system be installed within the receptacle 100. In this aspect the electronic user notification system is wirelessly connect to the recipient's Wi-Fi or to cellular service and is configured to alert the recipient, such as by a text or email message, to the delivery of a parcel placed into a receptacle 100.

Figure 5:
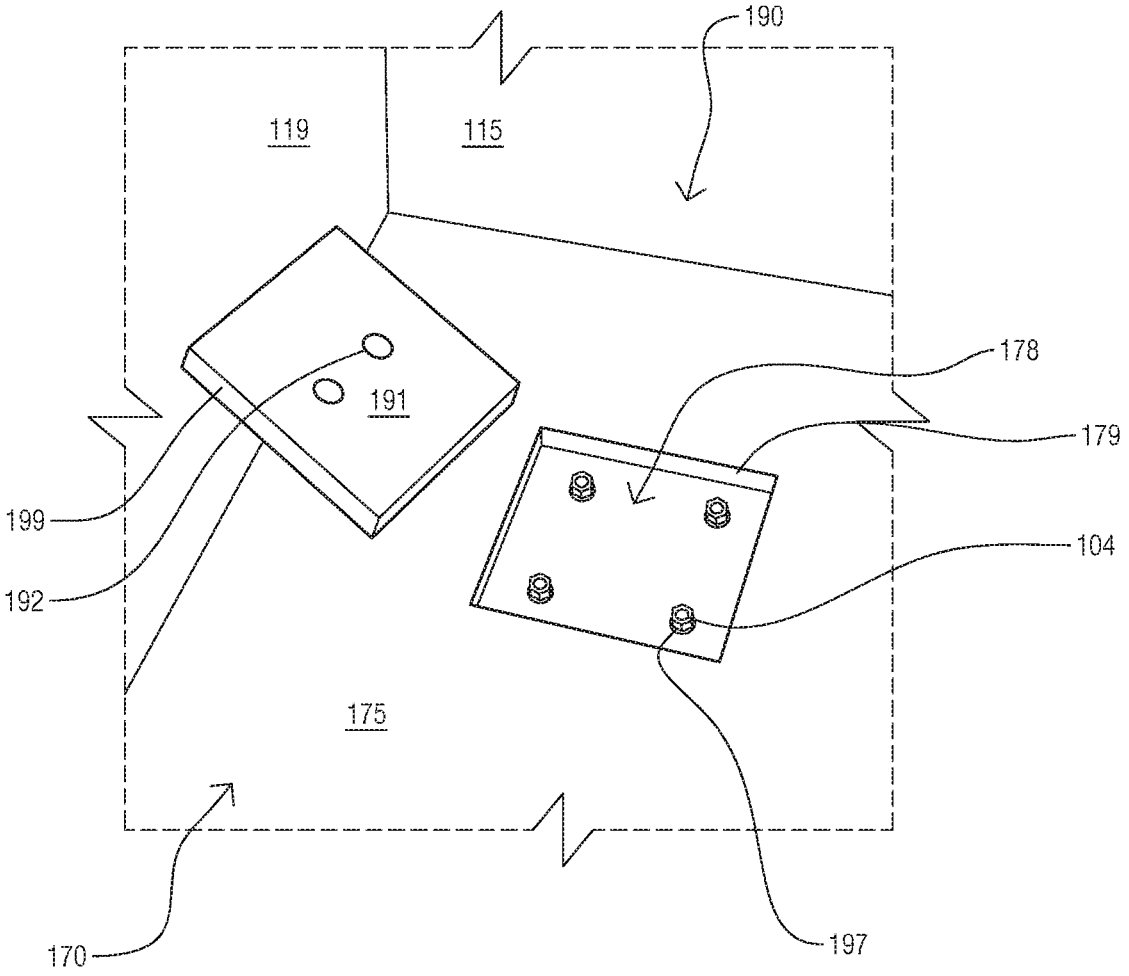
FIG. 5 is a closeup perspective view of the interior of an embodiment of the present invention showing the securing system, with the base of the securing system disposed under the central floor with only the projecting bolts of the base seen and with the cover of the securing system lifted above the floor to show the recess in the central area of the floor.
Figure 6:
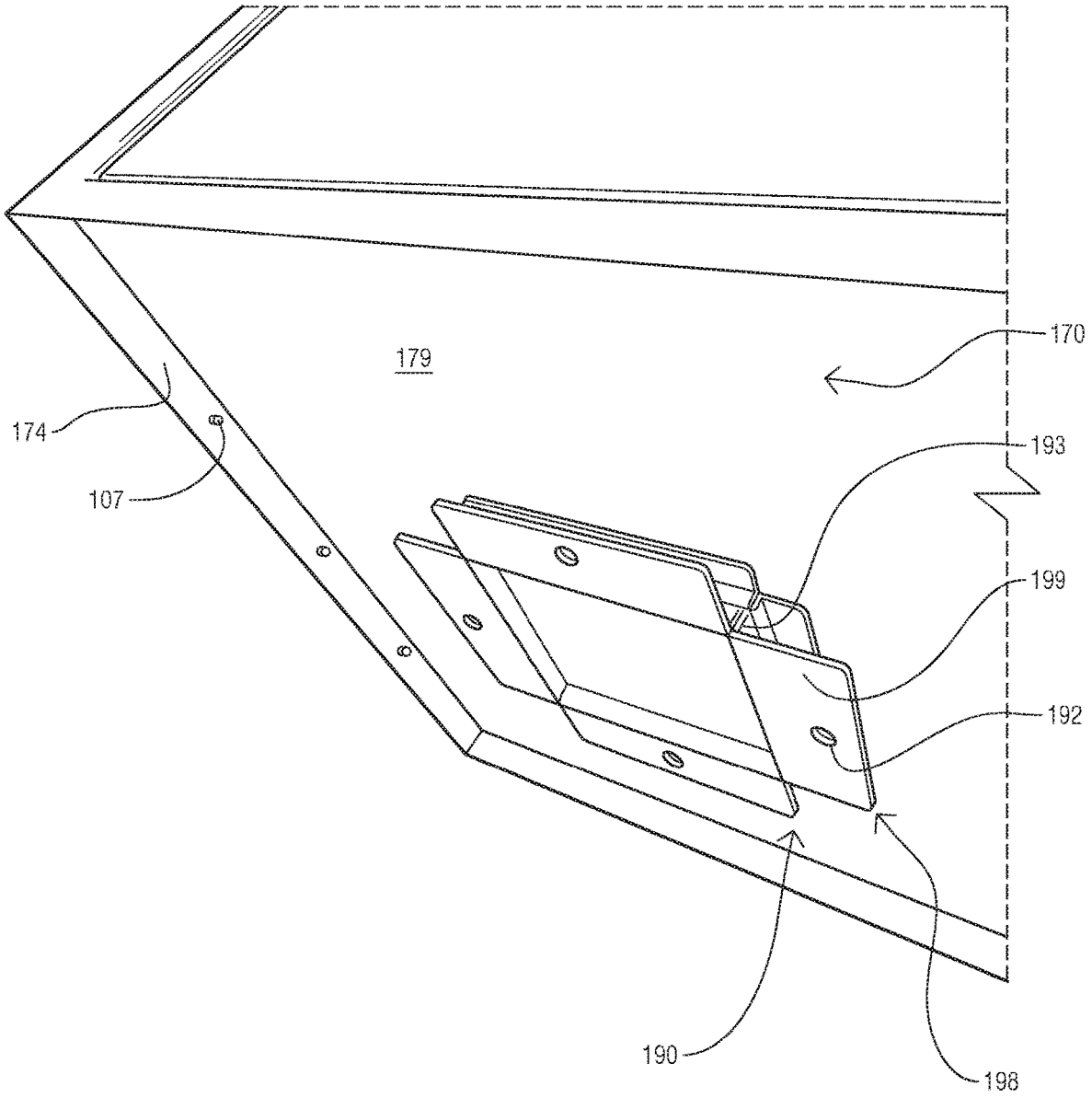
FIG. 6 is a closeup perspective view of the underside of an embodiment of the present invention showing the base of the anchoring/securing system as attached to the central area of the floor.

The floor 170 comprises a flat platform 175 (FIGS. 4, 8), a central recess 178 (FIG. 5), and side flanges 174 (FIGS. 4, 6). The side flanges 174 extend downwardly from and perpendicularly to the lateral and longitudinal edges of platform 175 forming corners. The downwardly extending flanges 174 (in combination with the securing system 190) support the platform 175 above the level of the supporting surface that the deposit receptacle 100 rests upon. The flat platform 175 has a top surface 171 (FIGS. 4, 8) and a bottom surface 179 (FIG. 6). The central recess 178 is an alcove or depression within the central area of the flat platform 175 that is sized and shaped to accommodate the securing system top cover 195. The manual placement of the cover 195 into the central recess 178 allows the flat top surface 191 of the securing system top cover 195 to be substantially in line with the flat top surface 171 of the floor 170 to create a substantially planar two-part (cover surface 191 and platform surface 173) surface. This provides a substantially flat bottom flooring for the interior compartment 101, even though it is composed of two separate elements, flat platform 175 and cover 195.

The downwardly extending flanges 174 form a lip extending downwardly from the flat platform 175 to the supporting surface under the deposit receptacle 100, thereby creating a subspace between the bottom surface 179 of the flat platform 175 and the supporting surface. The flange 174 extends downwardly from the flat platform 175 a distance sufficient to allow the base 198 of the securing system 190 to be inset within this subspace. Therefore, the distance that the downwardly extending flanges 174 extend downwardly from the platform is approximately equal to the height of the securing bottom base 198 of the securing system 190. The deposit receptacle 100 rests upon the downwardly extending flanges 174 and the securing system base 198.

Figure 7:
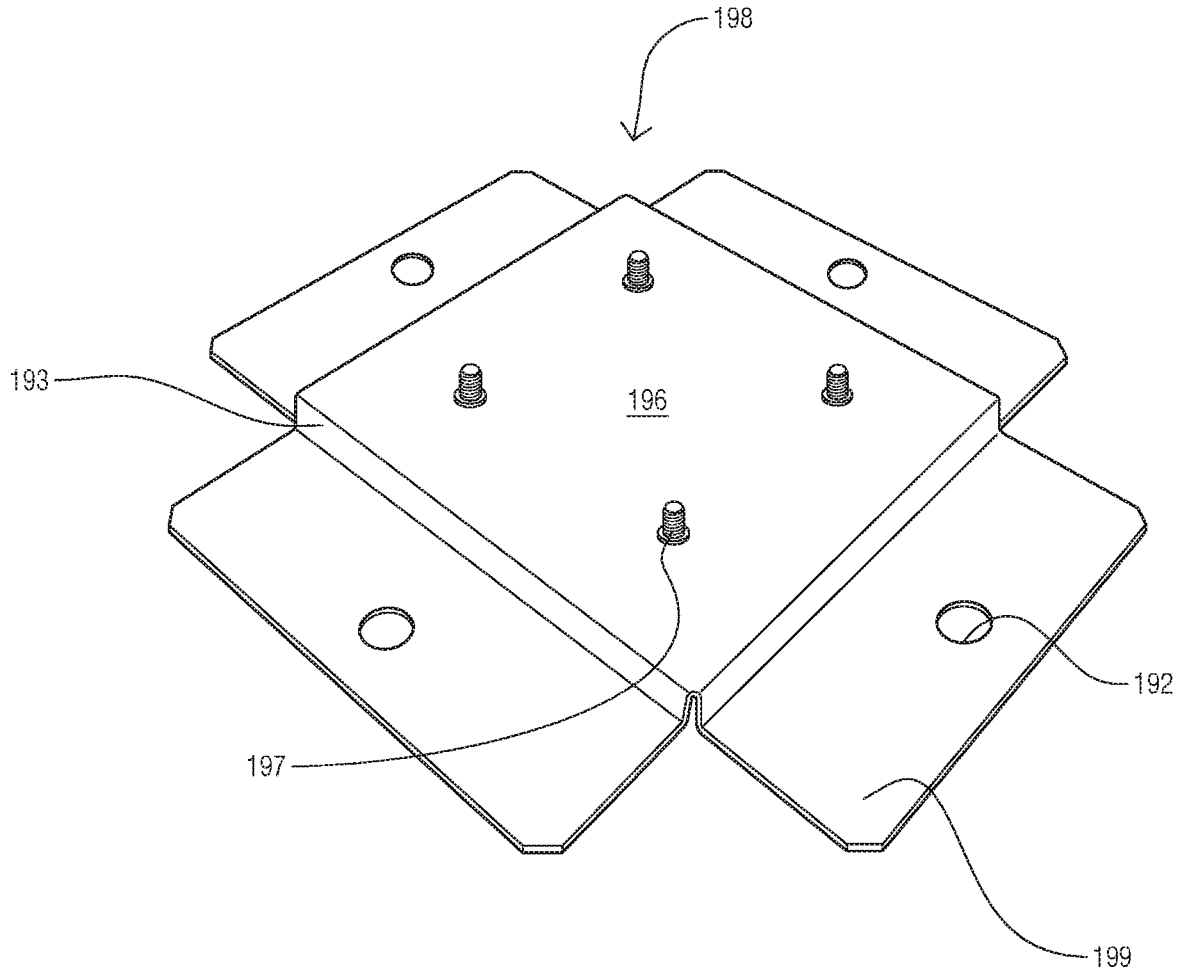
FIG. 7 is a perspective view of the base of the anchoring/securing system of an embodiment of the present invention.

As seen in FIGS. 6-8, the securing system bottom base 198 comprises a planar portion 196 rimmed by downwardly projecting lips 193 on each of the sides that extend to form planar extensions 199 that, when installed, are positioned against the supporting surface. Preferably, the planar portion 196, downwardly projecting lips 197, and planar extensions 199 are formed of a single piece of metal for strength. For ease of manufacturing, the planar portion 196 may be square or rectangular, as illustrated, but it may alternatively take other shapes, such as a circle, triangle, pentagon, or other geometric or irregular shape.

The securing system bottom base 198 is configured with extension holes defined by hole edges 192 that are configured to receive foundation fasteners (such as bolts, screws, or anchors) that secure the base 198 to the supporting surface. Fasteners selected for use are appropriate for the particular type of supporting surface by which the deposit receptacle 100 will be supported. For example, if attaching the securing system bottom base 198 to a wooden porch, the fasteners may be relatively long wood screws having a tapered shank with helical thread topped with a slotted head. Or when attaching the securing system bottom base 198 to a concrete supporting surface, the fasteners may be concrete anchors, such as adhesive anchors, wedge anchors, expansion and undercut anchors, and other devices that are suitable for anchoring the securing system bottom base 198 into concrete.

The securing system bottom base 198 also comprises upwardly projecting bolts 197. The bolts 197, for ease of use, preferably have heads that are permanently affixed to or integrated into the planar portion 196. The projecting bolts 197 fit through the holes defined by floor hole edges 176 (FIG. 8) of the recessed planar portion 178 of the floor 170, and then they are captured by the mating nuts 104.

The cover 195 comprises a flat surface 191 surrounded by downwardly-projecting lips 194. The height of the lips 194 is just less than the height of the floor central recess 178, so that the flat top surface 191 of the securing system top cover 195 is substantially in line with the top surface 171 of the floor 170. The cover 195 is also configured with one or multiple finger holes defined by finger hole edges 88. The holes allow the convenient installation and removal of the cover 195.

To install the deposit receptacle 100, a suitable site is located and the deposit receptacle 100 is obtained, along with standard nuts 104 and standard anchoring fasteners that are suitable for the type of supporting surface on which the receptacle 100 will be placed. The securing system 190 base 198 is installed first. The base 198 is laid on the supporting surface. The shaft of each anchoring fastener is fitted into the holes 192 of the planar extensions 199, and the anchoring fasteners are tightened to secure the base 198 to the supporting surface. When the base 198 is securely attached, the base bolts 197 will be oriented upwardly. The deposit receptacle 100 is then positioned over the base 198 with each hole defined by floor hole edges 176 in the recessed planar portion 178 of the floor 170 receiving the corresponding base bolt 197. The nuts 104 are then threadingly engaged with the bolts 197, with or without the addition of washers. This anchors the delivery receptacle 100 easily and securely onto the supporting surface. To finish, the securing system top cover 195 is fitted into the floor central recess 178, with the central recess 178 of the floor 170 interposed between the base 198 and the cover 195.

Though the delivery receptacle 100 is preferably formed of metal, all or parts of it may be formed of plastic resins, parts of it may be formed of wood, or a combination of materials may be used.

The invention illustratively disclosed herein suitably may be practiced in the absence of any element which is not specifically disclosed herein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A deposit receptacle, comprising:

an exterior housing defining an interior compartment comprising a frame; a front pivoting upper input door; a front locking hinged lower retrieval door; a front panel; a side access door; a roof portion comprising a top covering, a front sidewall, a back sidewall, a left sidewall, and a right sidewall; and a floor portion having a central recess;

a securing system comprising a lower base for attachment to a supporting surface upon which said deposit receptacle is to rest and an upper cover that is received by said central recess; and a hanger system comprising a hanger rod positioned within the interior compartment.

2. The deposit receptacle, as recited in claim 1 wherein said hanger system further comprises two flat plates attached at opposing ends of said hanger rod; and wherein one of said two flat plates is attached to the interior of said front sidewall of said roof portion and the other of said two flat plates is attached to the interior of said back sidewall of said roof portion.

3. The deposit receptacle, as recited in claim 1 wherein said top covering of said roof portion is peaked.

4. The deposit receptacle, as recited in claim 1 wherein:

said base comprises a planar portion, downwardly-projecting lips, multiple upwardly projecting bolts, and outwardly-projecting extensions;

said central recess of said floor portion is configured with floor holes defined by floor hole edges; and each of said multiple upwardly projecting bolts is received by one of said floor holes.

5. The deposit receptacle, as recited in claim 1 wherein:

said floor portion comprises a flat platform and side flanges extending downwardly from said flat platform; and said securing system base has a vertical height substantially equal to the vertical height of said flanges.

6. The deposit receptacle, as recited in claim 1 wherein said frame comprises:

a left front post extending vertically between said roof portion and said floor portion; and a two-panel portion comprising:

a right front post extending vertically between said roof portion and said floor portion;

a left rear post extending vertically between said roof portion and said floor portion;

a right side panel extending rearwardly from right front post and extending vertically between said roof portion and said floor portion; and a back panel extending laterally from said left rear post and extending vertically between said roof portion and said floor portion.

7. The deposit receptacle, as recited in claim 6 wherein said right side panel is attached at a substantially 90-degree angle to said back panel.

8. The deposit receptacle, as recited in claim 6 wherein:

said front pivoting upper input door is pivotally attached to said right front post and to said left front post;

said front locking hinged lower retrieval door is hingedly attached to one of said right front post or said left front post;

said front panel is attached between said right front post and said left front post; and said side access door is hingedly attached to said left rear post.

9. The deposit receptacle, as recited in claim 6 wherein:

said front pivoting upper input door comprises a front face panel, a left pivot pin, and a right pivot pin; and said right front post and said left front post accommodate said right pivot pin and said left pivot pin in a manner to enable said front pivoting upper input door to pivot upon said right pivot pin and said left pivot pin.

10. The deposit receptacle, as recited in claim 6 wherein:

said front pivoting upper input door comprises a front face panel extending laterally between said right front post and said left front post and extending rearwardly from a face front edge to a face back portion, a ledge comprising a ledge front portion attached to said face back portion and a ledge back portion extending rearwardly into said housing interior compartment, a shelf comprising a shelf front portion attached to said ledge back portion and a shelf back portion extending rearwardly into said housing interior compartment, a left stop and a right stop extending outwardly from said front pivoting upper input door;

said right front post is configured with a right notch that receives said right stop when said front pivoting upper input door is pivoted outwardly; and said left front post is configured with a left notch that receives said left stop when said front pivoting upper input door is pivoted outwardly.

11. The deposit receptacle, as recited in claim 6 wherein:

said front pivoting upper input door comprises a side barrier extending upwardly at substantially a ninety-degree angle from two opposing outer edges of at least one of the following: a-front face panel of said front pivoting upper input door, a ledge of said front pivoting upper input door, or a said shelf of said front pivoting upper input door.

12. A deposit receptacle, comprising:

an exterior housing defining an interior compartment comprising a frame; a front pivoting upper input door; a front locking hinged lower retrieval door; a front panel extending vertically between said front pivoting upper input door and said front locking hinged lower retrieval door; a roof portion; a floor portion having a central recess; and a side access door extending vertically between said roof portion and said floor portion; wherein said frame comprises a left front post, a right front post, and a left rear post;

a securing system comprising a lower base for attachment to a supporting surface upon which said deposit receptacle is to rest and an upper cover to be received by said central recess; wherein said base comprises a planar potion, downwardly-projecting lips, and outwardly-projecting extensions configured with holes defined by extension hole edges; and a hanger system comprising a hanger rod positioned within the interior compartment.

13. The deposit receptacle, as recited in claim 12 wherein said frame further comprises:

a right side panel extending rearwardly from said right front post and extending vertically between said roof portion and said floor portion; and a back panel extending laterally from said left rear post and extending vertically between said roof portion and said floor portion.

14. The deposit receptacle, as recited in claim 12 wherein:

said front pivoting upper input door is pivotally attached to said right front post and to said left front post;

said front locking hinged lower retrieval door is hingedly attached to said right front post or to said left front post;

said front panel is attached between said right front post and said left front post;

said side access door is hingedly attached to said left rear post;

said front pivoting upper input door comprises a front face panel, an outwardly extending left pivot pin, and an outwardly extending right pivot pin; and said right front post and said left front post accommodate said right pivot pin and said left pivot pin in a manner to enable said front pivoting upper input door to pivot upon said right pivot pin and said left pivot pin.

15. The deposit receptacle, as recited in claim 12 wherein:

said front pivoting upper input door comprises a front face panel extending laterally between said right front post and said left front post and extending rearwardly from a face front edge to a face back portion, a ledge comprising a ledge front portion attached to said face back portion and a ledge back portion extending rearwardly into said housing interior compartment, a shelf comprising a shelf front portion attached to said ledge back portion and a shelf back portion extending rearwardly into said housing interior compartment, and a left stop and a right stop extending outwardly from said front pivoting upper input door;

said right front post is configured with a right notch that receives said right stop when said front pivoting upper input door is pivoted outwardly; and said left front post is configured with a left notch that receives said left stop when said front pivoting upper input door is pivoted outwardly.

16. The deposit receptacle, as recited in claim 12 wherein:

said base comprises multiple upwardly projecting bolts;

said central recess of said floor portion is configured with floor holes defined by floor hole edges; and each of said multiple upwardly projecting bolts is received by one of said floor holes.

17. The deposit receptacle, as recited in claim 12 wherein:

said floor portion comprises a flat platform and side flanges extending downwardly from said flat platform; and said securing system base has a vertical height substantially equal to the vertical height of said flanges.

18. A deposit receptacle, comprising:

an exterior housing defining an interior compartment comprising a frame; a front pivoting upper input door; a front locking hinged lower retrieval door; a front panel extending vertically between said front pivoting upper input door and said front locking hinged lower retrieval door; a roof portion; a floor portion comprising a flat platform, side flanges extending downwardly from said flat platform, and multiple floor hole edges defining floor holes; and a side access door extending vertically between said roof portion and said floor portion; wherein said frame comprises a left front post, a right front post, a left rear post, a right side panel, and a back panel; wherein said front pivoting upper input door is pivotally attached to said right front post and to said left front post; and wherein said side access door is hingedly attached to said left rear post;

a securing system comprising a lower base for attachment to a supporting surface upon which said deposit receptacle is to rest; wherein said base comprises a planar portion, downwardly-projecting lips, outwardly-projecting extensions configured with holes defined by extension hole edges, and upwardly projecting bolts that are accommodated by said floor holes; and a hanger system comprising a hanger rod and two flat plates attached at opposing ends of said hanger rod, wherein one of said two flat plates is attached to the interior of said roof portion and the other of said two flat plates is attached to the interior of said roof portion.

19. The deposit receptacle, as recited in claim 18 wherein:

said securing system base has a vertical height substantially equal to the vertical height of said flanges.

20. The deposit receptacle, as recited in claim 18 wherein:

said front pivoting upper input door comprises a front face panel extending laterally between said right front post and said left front post and extending rearwardly from a face front edge to a face back portion; a ledge comprising a ledge front portion attached to said face back portion and a ledge back portion extending rearwardly into said housing interior compartment; a shelf comprising a shelf front portion attached to said ledge back portion and a shelf back portion extending rearwardly into said housing interior compartment; a left stop and a right stop extending outwardly longitudinally from said front pivoting upper input door;

said right front post is configured with a right notch that receives said right stop when said front pivoting upper input door is pivoted outwardly; and said left front post is configured with a left notch that receives said left stop when said front pivoting upper input door is pivoted outwardly.

* * * * *